US006193537B1

(12) United States Patent
Harper, Jr. et al.

(10) Patent No.: US 6,193,537 B1
(45) Date of Patent: Feb. 27, 2001

(54) HERMAPHRODITIC CONTACT

(75) Inventors: Donald K. Harper, Jr., Harrisburg; Lewis R. Johnson, Liverpool, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/317,559

(22) Filed: May 24, 1999

(51) Int. Cl.[7] ..... H01R 13/28
(52) U.S. Cl. ..... 439/291
(58) Field of Search ..... 439/108, 290, 439/291, 293, 295, 856

(56) References Cited

U.S. PATENT DOCUMENTS

| | | | | |
|---|---|---|---|---|
| 3,115,379 | | 12/1963 | McKee . | |
| 3,259,869 | | 7/1966 | Batcheller . | |
| 4,820,182 | | 4/1989 | Harwath et al. | 439/290 |
| 5,035,639 | | 7/1991 | Kilpatrick et al. | 439/290 |
| 5,098,311 | | 3/1992 | Roath et al. | 439/289 |
| 5,127,839 | * | 7/1992 | Korsunsky et al. | 439/79 |
| 5,266,046 | | 11/1993 | Bogiel | 439/290 |
| 5,290,181 | * | 3/1994 | Bixler | 439/856 |
| 5,577,928 | | 11/1996 | Duclos | 439/290 |
| 5,588,859 | | 12/1996 | Maurice | 439/290 |
| 5,904,581 | * | 5/1999 | Pope et al. | 439/74 |

FOREIGN PATENT DOCUMENTS

WO 98/15991 4/1998 (WO) .

* cited by examiner

*Primary Examiner*—Khiem Nguyen
*Assistant Examiner*—J. I. Duverne
(74) *Attorney, Agent, or Firm*—Woodcock Washburn Kurtz Mackiewicz & Norris LLP

(57) ABSTRACT

A connector having a hermaphroditic contact is disclosed. Such hermaphroditic contact extends longitudinally and is formed as a unitary body from a conductive material. The contact has a base residing in a plane and extending longitudinally and traversely in the plane, a blade arm extending longitudinally from the base and generally in the plane of the base, and a spring arm extending longitudinally from the base alongside the blade arm. The spring arm is springingly displaceable toward at least a first side of the plane of the base. To electrically couple first and second generally identical ones of the contact, the bases of the first and second contacts are aligned to be co-planar, and the blade arm of the each contact is aligned to face toward the spring arm of the other contact. The first and second contacts are then moved together such that the blade arm of each contact encounters the spring arm of the other contact. Thereafter, the first and second contacts are further moved together such that the blade arm of each contact displaces the spring arm of the other contact toward the first side of the plane of the base of the other contact.

24 Claims, 2 Drawing Sheets

HERMAPHRODITIC CONTACT

FIELD OF THE INVENTION

The present invention relates to an electrical contact for mating with a substantially identical copy thereof. In particular, the present invention is for such an electrical contact having a blade arm and a spring arm.

BACKGROUND OF THE INVENTION

Relatively small yet relatively dense electrical connectors are employed in many applications. In one type of application, a first connector is mounted to a first substrate and a second, mating connector is mounted to a second substrate so that the first substrate may be electrically coupled to the second substrate by mating contacts on the first and second connectors. Typically, each of the first and second connectors have a plurality of electrical contacts mounted therein, and each contact in the first connector is for mating with a specific corresponding contact in the second connector. Such contacts in each of the first and second connectors may be arranged into rows and columns, staggered rows or any other desirable arrangement.

Generally speaking, each connector utilizes different contacts than the other connector. For example, the first connector could use pin contacts and the second connector could use receptacle contacts. In another type, the first connector could use blade contacts and the second connector could use spring arm, or beam contacts. Of course, other types of mate-able electrical connector pairs are extant.

Using different contacts for each connector in the pair has several disadvantages. First, each such different type of contact must be individually designed and produced. Second, each contact must be kept in inventory. Moreover, care must taken to ensure that the proper contact is mounted in the proper connector. Accordingly, a need exists for a connector having contacts where each contact can mate to a generally identical contact in a mating connector. With such hermaphroditic contacts, then, design and production costs are significantly reduced.

SUMMARY OF THE INVENTION

The present invention satisfies the aforementioned need by providing a hermaphroditic contact and a connector having such a hermaphroditic contact. Such hermaphroditic contact extends longitudinally and is formed as a generally unitary body from a conductive material. The contact has an intermediate portion generally residing in a plane and extending longitudinally and traversely in the plane, a blade arm extending longitudinally from the intermediate portion and generally in the plane of the intermediate portion, and a spring arm extending longitudinally from the intermediate portion alongside the blade arm. The spring arm is displaceable toward at least a first side of the plane of the intermediate portion during mating with the other contact.

To electrically couple first and second generally identical ones of the contact, the intermediate portions of the first and second contacts are aligned to be generally co-planar, and the blade arm of the each contact is aligned to face generally toward the spring arm of the other contact. The first and second contacts are then moved together such that the blade arm of each contact encounters the spring arm of the other contact. Thereafter, the first and second contacts are further moved together such that the blade arm of each contact displaces the spring arm of the other contact toward the first side of the plane of the intermediate portion of the other contact.

BRIEF DESCRIPTION OF THE DRAWINGS

The foregoing summary as well as the following detailed description of the embodiments of the present invention, will be better understood when read in conjunction with the appended drawings. For the purpose of the illustrating the invention, there are shown in the drawings embodiments which are presently preferred. As should be understood, however, the invention is not limited to the precise arrangements and instrumentalities shown. In the drawings.

DETAILED DESCRIPTION OF PREFERRED EMBODIMENTS

Figure 1:
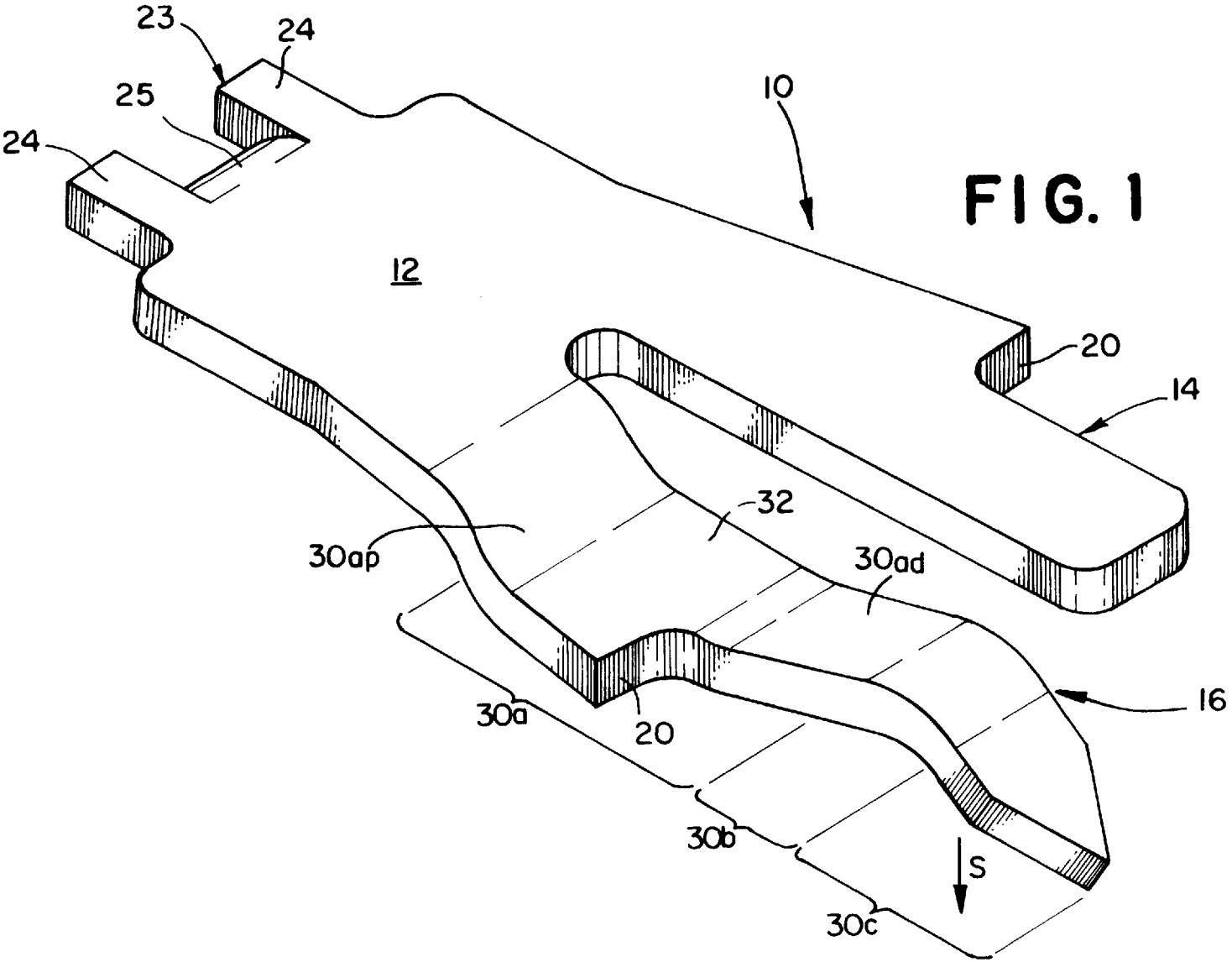
FIG. 1 is a perspective view of a hermaphroditic contact in accordance with one embodiment of the present invention.

Certain terminology may be used in the following description for convenience only and is not considered to be limiting. The words "left", "right", "upper", and "lower" designate directions in the drawings to which reference is made. The words "inwardly" and "outwardly" are further directions toward and away from, respectively, the geometric center of the referenced object. The terminology includes the words above specifically mentioned, derivatives thereof, and words of similar import.

Referring to the drawings in detail, wherein like numerals are used to indicate like elements throughout, there is shown in FIG. 1 a hermaphroditic electrical contact 10 in accordance with one embodiment of the present invention. As seen, the contact 10 extends generally longitudinally and is formed as a generally unitary body. The contact 10 includes an intermediate portion 12 that generally resides in a plane. Contact 10 has a mating portion extending from intermediate portion 12 to engage a mating portion of a mating contact 10 (shown in FIGS. 2A and 2B). The mating portion includes a blade arm 14 that extends longitudinally and generally in the plane of the intermediate portion 12, and a spring arm 16 that extends longitudinally from the intermediate portion 12 alongside the blade arm 14. The distal ends of the blade arm 14 and spring arm 16 are adjacent one another although spring arm 16 can extend further from intermediate portion 12. Preferably, the spring arm 16 is springingly displaceable toward at least a first side of the plane of the intermediate portion 12 as shown by the arrow S in FIG. 1 when mating with another contact 10.

Preferably, the contact 10 is constructed from a conductive material, such as beryllium-copper or phosphor-bronze with suitable plating in the mating area. Preferably, the method of constructing the contact 10 is by stamping and forming a sheet of material. The stamping operation may cut the contact from the sheet while the forming operation provides the bends. Alternatively, the contact 10 may be formed by molding or any other suitable process. At any rate, it will be recognized that other materials and other methods of construction may be employed without departing from the spirit and scope of the present invention.

Figure 2A:
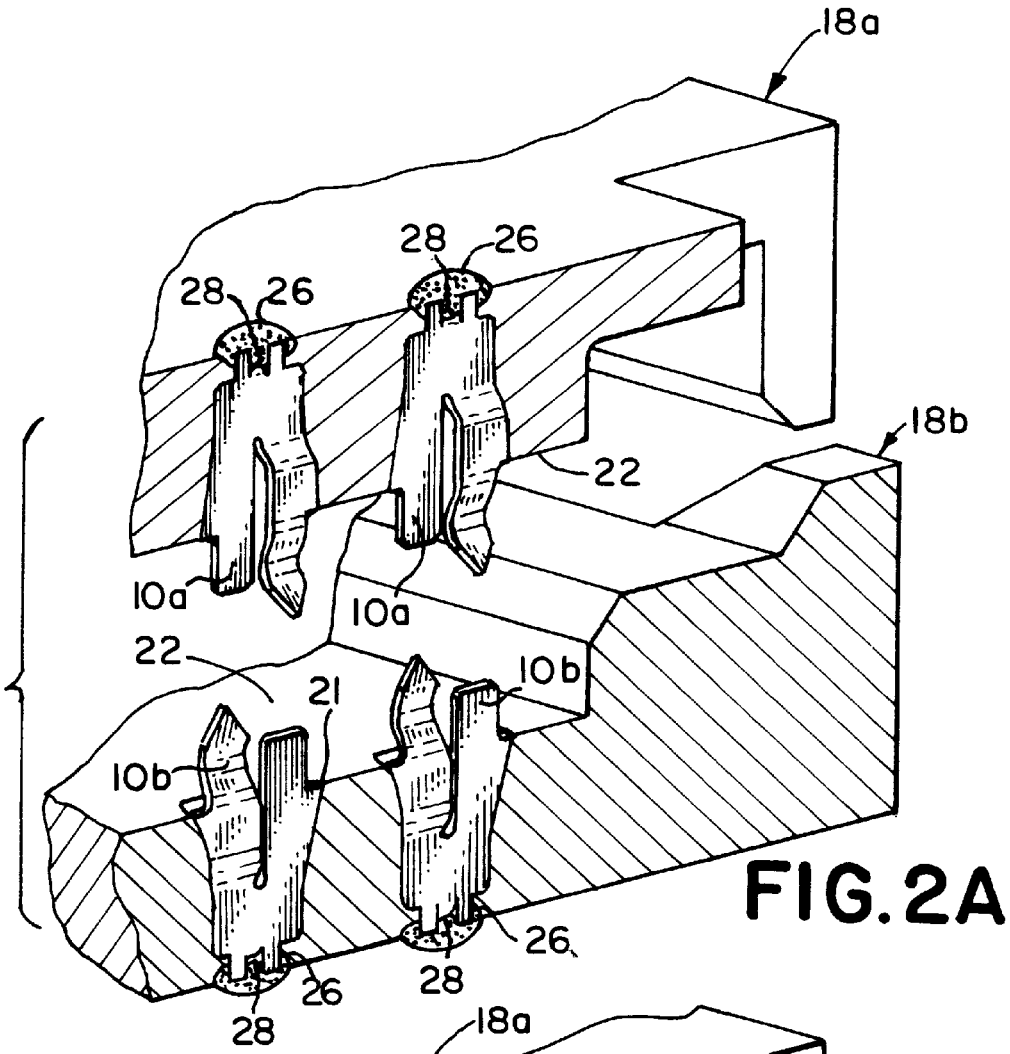
FIGS. 2A and 2B are perspective views of first and second ones of the hermaphroditic contact of FIG. 1 mounted in first and second connectors, respectively, where the connectors/contacts are mated by being aligned with respect to each other (FIG. 2A), and by being moved toward and encountering each other (FIG. 2B).
Figure 2B:
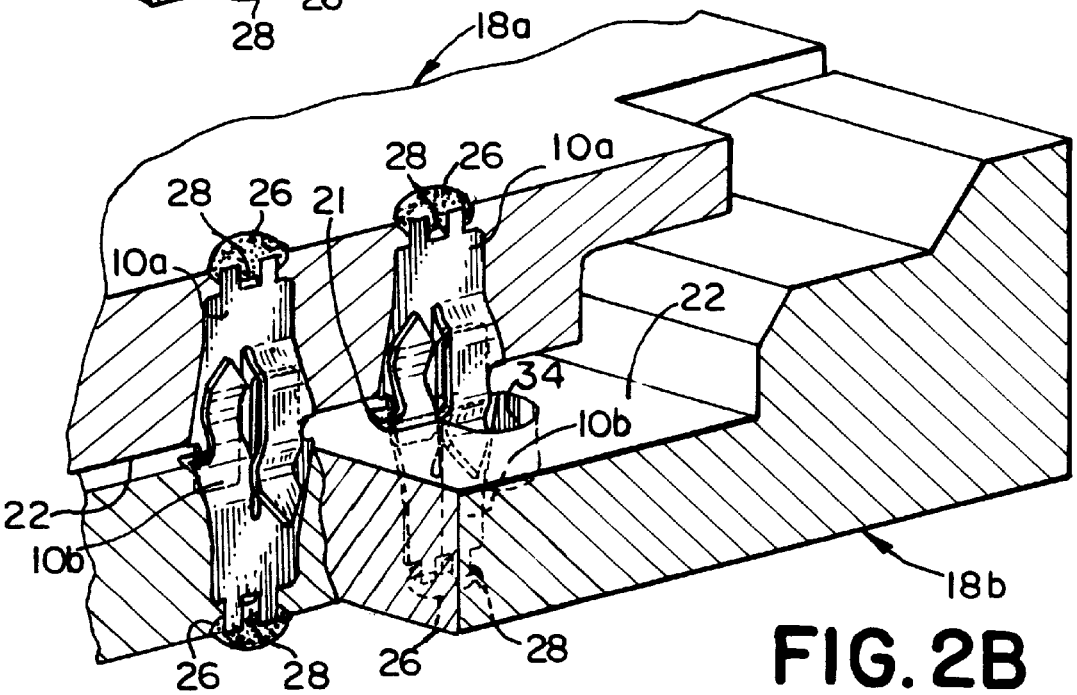

Referring now to FIGS. 2A and 2B, it is seen that first and second generally identical contacts 10*a*, 10*b* may be mounted in first and second paired mating connector housings 18*a*, 18*b* (two pairs of such first and second contacts

10*a* and 10*b* are shown). Preferably, each connector 18*a*, 18*b* is molded from a suitable dielectric material such as a thermoplastic like a liquid crystal polymer (LCP) into a final form which includes defined apertures for each respective contact 10*a,* 10*b*. However other methods of formation of the connectors 18*a*, 18*b* may be employed without departing from the spirit and scope of the present invention.

As seen, each contact 10, 10*a,* 10*b* includes a pair of shoulders 20 where each shoulder 20 is associated with one of the blade arm and spring arm 14, 16. Preferably, each contact 10*a,* 10*b* is inserted within an aperture 21 in a respective connector housing 18*a*, 18*b* through a floor 22 thereof (best seen in FIG. 2B) such that each shoulder 20 of each contact 10*a,* 10*b* is generally flush with the floor 22 of the respective connector 18*a*, 18*b*. As should be understood, the floors of the connectors 18*a*, 18*b* are the respective generally planar surfaces that face each other when the connectors 18*a*, 18*b* are mated to one another. Preferably, each aperture 21 has a deformable rib (not shown) at a central location. The rib retains contacts 10*a,* 10*b* within apertures 21 by an interference fit. Alternatively, apertures 21 could have generally planar side walls (i.e. no ribs) spaced close together such that a received contact 10*a,* 10*b* maintains a snug interference fit therein.

The insertion of each contact 10*a,* 10*b* into the aperture 21 of the respective connector 18*a*, 18*b* may be performed by any of several known processes without departing from the spirit and scope of the present invention. For example, each contact 10*a,* 10*b* may be machine inserted within an aperture 21 in an already-formed connector 18*a*, 18*b* by mechanical means. Alternatively, each contact 10*a,* 10*b* may be over-molded in situ during formation of the respective connector 18*a*, 18*b*.

Referring again to FIG. 1, it is seen that the intermediate portion 12 of the contact 10 includes a mounting portion 23 generally opposite the blade arm and spring arm 14, 16. As seen in FIGS. 2A and 2B, mounting portion 23 could receive a fusible element such as a solder ball 28 to surface-mount the connector 18*a*, 18*b* to a substrate using, for example, ball grid array (BGA) technology. Intl. Pub. No. WO 98/15991, hereby incorporated by reference, describes methods for securing a fusible element to a contact and for securing a connector using fusible elements to a circuit substrate. As seen, the mounting portion 23 includes a pair of laterally arranged posts 24 extending longitudinally from the intermediate portion 12. A re-flow step fuses the solder ball 28 to the mounting portion 23. Preferably, posts 24 reside within the fused solder ball 28. In general, any structure for forming the solder ball mounting portion 23, such as, for example, a bent tab, may be employed without departing from the spirit and scope of the present invention. In addition, a contact 10 could use a different type of termination (e.g. solder tail, press-fit, pin-in-paste).

The mounting portion 23 of contact 10 also includes a centrally located region between the posts 24, where the region includes a shaped edge 25 that may be formed by a coining process. Such coining process smooths the edge 25 and provides a tapered or rounded edge 25. During insertion of contact 10 into aperture 21 in the housing 18, the rounded edge 25 prevents skiving of the retaining rib within the aperture 21. The absence of skived material obviates the need for a removing process before the placing and re-flowing of the solder ball 28. As best seen in FIGS. 2A and 2B, with each contact 10*a,* 10*b* inserted in each connector 18*a*, 18*b*, the solder ball mounting portion 23 of such contact 10 preferably resides, at least partially, within a well 26 on the surface of the respective connector 18*a*, 18*b* opposite the floor 22 thereof. As positioned, each solder ball mounting portion 23 may then receive and hold a solder ball 28 and/or solder paste also at least partially residing in well 26. Any method of attaching a solder ball 28 to each solder ball mounting portion 23 may be employed without departing from the spirit and scope of the present invention. Furthermore, mounting portion 23 could extend past well 26.

In general, any method of attaching a solder ball 28 to each solder ball mounting portion 23 may be employed without departing from the spirit and scope of the present invention. Of course, if a solder ball 28 is not to be employed to couple each contact 10 to a corresponding electrical pad on a substrate, the posts 24 and rounded edge 25 may not be necessary, and may be substituted with other suitable terminations without departing from the spirit and scope of the present invention.

Referring still to FIGS. 2A and 2B, it is seen that the first and second connectors 18*a*, 18*b* are coupled to one another and that respective first and second generally identical ones of the contacts 10*a,* 10*b* are electrically coupled to one another by performing the following steps. First, the intermediate portions 12 of each corresponding pair of first and second contacts 10*a,* 10*b* are aligned to be generally co-planar. Preferably, each contact 10*a,* 10*b* is positioned in a respective connector 18*a*, 18*b* such that alignment of, for example, the peripheral walls of the connectors 18*a*, 18*b* automatically aligns the intermediate portions 12 of the respective first and second contacts 10*a,* 10*b* to be coplanar.

As seen from FIGS. 2A and 2B, the pair of mating connectors 18*a*, 18*b* preferably include various keying features such as shoulders and extensions. As should be understood, such keying features act to precisely position the connectors 18*a*, 18*b* and by extension each corresponding pair of contacts 10*a,* 10*b* with respect to each other when such connectors 18*a*, 18*b* are being mated to each other. Accordingly, such contacts 1*a,* 10*b* are not inadvertently crumpled or otherwise damaged due to a mis-alignment during mating.

Thereafter, the blade arm 14 of each contact 10*a,* 10*b* is aligned to face generally toward the spring arm 16 of the other contact 10*a,* 10*b*. Of course, in the context of the connectors 18*a*, 18*b* this is accomplished in connection with the previous aligning step merely by ensuring that the floors 22 of the connector 18*a*, 18*b* face toward each other.

Once properly aligned, as is seen in FIG. 2A, the connectors 18*a*, 18*b*, and by extension the first and second contacts 10*a,* 10*b,* are moved together, such that the blade arm 14 of each contact 10*a,* 10*b* encounters the spring arm 16 of the opposite contact 10*a,* 10*b*. As should be understood, the aforementioned keying features incorporated within the connectors 18*a*, 18*b* and the respective contacts 10*a*, 10*b* ensure that such encountering occurs in proper alignment.

Thereafter, the connectors 10*a,* 10*b,* and by extension the first and second contacts 10*a,* 10*b,* are further moved together such that the blade arm 14 of each contact 10*a,* 10*b* displaces the spring arm 16 of the opposite contact 10*a,* 10*b* toward the first side of the intermediate portion 12 of the opposite contact 10*a,* 10*b*. Again, such first side of such intermediate portion 12 is shown by the direction of the arrow S in FIG. 1.

Referring again to FIG. 1, it is seen that the spring arm 16 of each contact 10 preferably includes first, second, and third portions 30*a*, 30*b*, 30*c* as delineated by the respective brackets. As seen, the first portion 30*a* is relatively close to the intermediate portion 12 and serves to extend arm 16 away from the plane of such intermediate portion 12. The second portion 30*b* is further away from the intermediate portion 12 than the first portion 30*a* and has a mating portion that approaches and generally resides in the plane of the intermediate portion 12. The third portion 30*c* is further away from the intermediate portion 12 than the second portion 30*b* and serves to extend the distal tip of arm 16 away from the plane of intermediate portion 12 as represented by the direction of the arrow S in FIG. 1. As seen, the third portion 30*c* generally curves away from the second portion 30*b* and toward such first side.

As should be understood, with the spring arm 16 having the first, second, and third portions 30*a*, 30*b*, 30*c* as described and shown, when the first and second contacts 10*a*, 10*b* are moved together, the blade arm 14 of each contact 10*a*, 10*b* may first encounter the third portion 30*c* of the spring arm 16 of the opposite contact 10*a*, 10*b*. Third portion 30*c* acts as a lead-in surface to accommodate slight misalignments of the contacts 10*a*, 10*b*. Likewise, when such first and second contacts 10*a*, 10*b* are further moved together such that displacement of each spring arm 16 occurs, the blade arm 14 of each contact 10*a*, 10*b* encounters the second portion 30*b* of the spring arm 16 of the opposite contact 10*a*, 10*b*.

Preferably, and as seen in FIG. 1, the first portion 30*a* of the spring arm 16 generally resides on the first side of the plane of the intermediate portion 12, as referenced by the direction of the arrow S. In particular, it is preferable that the first portion 30*a* of the spring arm 16 of the contact 10 have a proximal end 30*ap* that curves toward the intermediate portion 12 of such contact 10 and a distal end 30*ad* that curves toward the second portion 30*b*. Accordingly, when viewed from one lateral side thereof, the spring arm 16 generally exhibits an S-shape. Of course, other particular shapes may be employed without departing from the spirit and scope of the present invention.

As shown, the first portion 30*a* having the aforementioned ends 30*ap*, 30*ad* defines a blade arm acceptance region 32 that is generally adjacent such first portion 30*a* and that is generally in the plane of the intermediate portion 12. As should now be understood, after the first and second contacts 10*a*, 10*b* have been further moved together, such first and second contacts 10*a*, 10*b* may be still further moved together such that the blade arm 14 of each contact 10*a*, 10*b* enters the blade arm acceptance region 32 of the opposite contact 10*a*, 10*b* while continuing to displace the spring arm 16 of such opposite contact 10*a*, 10*b* in the direction of the arrow S. Of course, in such position, the blade arm 14 of each contact 10*a*, 10*b* also continues to encounter the second portion 30*b* of the spring arm 16 of the opposite contact 10*a*, 10*b*.

Preferably, and as best seen in FIGS. 2A and 2B, the floor 22 of each connector 18*a*, 18*b* defines a well 34 as part of the aperture 21. The well 34 can include a relatively larger opening adjacent the blade arm 14 of each connector 10*a*, 10*b* and a relatively smaller opening adjacent the spring arm 16 and on the opposite side of aperture 21 from the larger opening. Preferably, each contact 10*a*, 10*b* is inserted within an aperture 21 and each aperture 21 is formed such that both the blade arm 14 and the spring arm 16 of each contact 10*a*, 10*b* extend longitudinally and generally perpendicularly with respect to such floor 22 of the respective connector 10*a*, 10*b*. Accordingly, when each contact 10*a*, 10*b* in one connector 18*a*, 18*b* is electrically coupled to a generally identical corresponding contact 10*a*, 10*b* in an opposite connector 18*a*, 18*b*, the larger opening of the well 34 adjacent the blade arm 14 of each contact 10*a*, 10*b* accommodates the spring arm 16 of the opposite contact 10*a*, 10*b*, and the smaller opening of the well 34 adjacent the spring arm 16 accommodates the blade arm 14 of the opposite contact 10*a*, 10*b*. In particular, the larger opening of such well 34 accommodates at least the second and third portions 30*b*, 30*c* of such spring arm 16. The larger opening of the well 34 has a size suitable to allow deflection of the arm 16 during mating of the connectors 18*a*, 18*b*. The smaller opening of the well 34 is sized to receive a distal tip of such blade arm 14 without substantial interference.

In the foregoing description, it can be seen that the present invention comprises a new and useful hermaphroditic electrical contact 10, 10*a*, 10*b* for being mounted in a connector 18*a*, 18*b* and for mating to a substantially identical contact 10, 10*a*, 10*b*. It should be appreciated that changes could be made to the embodiments described above without departing from the inventive concepts thereof. It should be understood, therefore, that this invention is not limited to the particular embodiments disclosed, but it is intended to cover modifications within the spirit and scope of the present invention as defined by the appended claims.

What is claimed is:

1. A longitudinally extending hermaphroditic contact formed as a generally unitary body from a conductive material and comprising:

an intermediate portion generally residing in a plane and extending longitudinally and laterally in the plane;

a blade arm extending longitudinally from the intermediate portion and generally in the plane of the intermediate portion;

a spring arm extending longitudinally from the intermediate portion alongside the blade arm, the spring arm being springingly displace-able toward at least a first side of the plane of the intermediate portion; and a mounting portion extending from the intermediate portion generally opposite the blade arm and the spring arm and generally in-line therewith the mounting portion being generally co-planar with the intermediate portion.

2. The contact of claim 1 wherein the blade arm and the spring arm are laterally arranged and both extend from the intermediate portion in one general longitudinal direction.

3. The contact of claim 1 wherein the spring arm has:

a first portion relatively close to the intermediate portion;

a second portion farther away from the intermediate portion than the first portion and generally residing in the plane of the intermediate portion; and a third portion farther away from the intermediate portion than the second portion and generally residing on the first side of the plane of the intermediate portion, the third portion generally extending away from the second portion and toward such first side.

4. The contact of claim 3 wherein the first portion of the spring arm generally resides on the first side of the plane of the intermediate portion, the first portion thereby defining a blade arm acceptance region adjacent thereto and generally in the plane of the intermediate portion.

5. The contact of claim 4 wherein the first portion of the spring arm has a proximal end curving toward the intermediate portion and a distal end curving toward the second portion.

6. The contact of claim 1 mounted to a floor of a connector, the blade arm and the spring arm both extending longitudinally and generally perpendicularly with respect to the floor of the connector, the floor of the connector defining a well adjacent the blade arm on a second side of the plane of the intermediate portion opposite the first side, wherein when the contact is electrically coupled to a generally identical corresponding contact, the well accommodates the spring arm of the corresponding contact.

7. A longitudinally extending hermaphroditic contact formed as a generally unitary body from a conductive material and comprising:

an intermediate portion defining a plane;

a mounting portion extending from the intermediate portion in a first direction, the mounting portion being generally co-planar with the intermediate portion; and a mating portion extending from the intermediate portion in a second direction generally opposite the first direction, the mating portion having:

a blade generally coplanar with the intermediate portion; and a spring arm adjacent the blade and residing at least partially outside the plane of the intermediate portion.

8. The contact of claim 7 wherein the blade and the spring arm are laterally arranged and both extend from the intermediate portion in one general longitudinal direction.

9. The contact of claim 7 wherein the spring arm has:

a first portion relatively close to the intermediate portion;

a second portion farther away from the intermediate portion than the first portion and generally residing in the plane of the intermediate portion; and a third portion farther away from the intermediate portion than the second portion and generally residing on a first side of the plane of the intermediate portion, the third portion generally extending away from the second portion and toward such first side.

10. The contact of claim 9 wherein the first portion of the spring arm generally resides on the first side of the plane of the intermediate portion, the first portion thereby defining a blade arm acceptance region adjacent thereto and generally in the plane of the intermediate portion.

11. The contact of claim 10 wherein the first portion of the spring arm has a proximal end curving toward the intermediate portion and a distal end curving toward the second portion.

12. The contact of claim 7 mounted to a floor of a connector, the blade and the spring arm both extending longitudinally and generally perpendicularly with respect to the floor of the connector, the floor of the connector defining a well adjacent the blade arm, wherein when the contact is electrically coupled to a generally identical corresponding contact, the well accommodates the spring arm of the corresponding contact.

13. A longitudinally extending hermaphroditic contact formed as a generally unitary body from a conductive material and comprising:

an intermediate portion having generally opposing edges and defining a plane;

a mounting portion extending from one of the edges of the intermediate portion; and a bifurcated mating portion extending from the other of the edges of the intermediate portion, the mating portion having:

a blade extending generally parallel to the plane of the intermediate portion; and a spring arm adjacent the blade and residing at least partially outside the plane of the intermediate portion, the spring arm having an arcuate shape, the mounting portion extending from the edge of the intermediate portion within a lateral boundary defined by the blade arm and the spring arm.

14. The contact of claim 13 wherein the blade and the spring arm are laterally arranged and both extend from the intermediate portion in one general longitudinal direction.

15. The contact of claim 13 wherein the spring arm has:

a first portion relatively close to the intermediate portion;

a second portion farther away from the intermediate portion than the first portion and generally residing in the plane of the intermediate portion; and a third portion farther away from the intermediate portion than the second portion and generally residing on a first side of the plane of the intermediate portion, the third portion generally extending away from the second portion and toward such first side.

16. The contact of claim 15 wherein the first portion of the spring arm generally resides on the first side of the plane of the intermediate portion, the first portion thereby defining a blade arm acceptance region adjacent thereto and generally in the plane of the intermediate portion.

17. The contact of claim 16 wherein the first portion of the spring arm has a proximal end curving toward the intermediate portion and a distal end curving toward the second portion.

18. The contact of claim 13 mounted to a floor of a connector, the blade and the spring arm both extending longitudinally and generally perpendicularly with respect to the floor of the connector, the floor of the connector defining a well adjacent the blade arm, wherein when the contact is electrically coupled to a generally identical corresponding contact, the well accommodates the spring arm of the corresponding contact.

19. An interconnection system comprising first and second mate-able connectors, each of the first and second connectors having:

a housing; and a plurality of contacts mounted in the housing, each contact being a longitudinally extending hermaphroditic contact formed as a generally unitary body from a conductive material and including:

an intermediate portion defining a plane;

a mounting portion extending from the intermediate portion in a first direction, the mounting portion being generally co-planar with the intermediate portion; and a mating portion extending from the intermediate portion in a second direction generally opposite the first direction, the mating portion having:

a blade generally coplanar with the intermediate portion; and a spring arm adjacent the blade and residing at least partially outside the plane of the intermediate portion;

each contact in the first connector having a corresponding generally identical contact in the second connector, wherein the blades of each pair of corresponding contacts are generally coplanar during mating of the first and second connectors.

20. The system of claim 19 wherein the blade and the spring arm in each contact are laterally arranged and both extend from the intermediate portion in one general longitudinal direction.

21. The system of claim 19 wherein the spring arm in each contact has:

a first portion relatively close to the intermediate portion of the contact;

a second portion farther away from the intermediate portion than the first portion and generally residing in the plane of the intermediate portion; and a third portion farther away from the intermediate portion than the second portion and generally residing on a first side of the plane of the intermediate portion, the third portion generally extending away from the second portion and toward such first side.

22. The system of claim 21 wherein the first portion of the spring arm of each contact generally resides on the first side of the plane of the intermediate portion of the contact, the first portion thereby defining a blade arm acceptance region adjacent thereto and generally in the plane of the intermediate portion.

23. The system of claim 22 wherein the first portion of the spring arm of each contact has a proximal end curving toward the intermediate portion of the contact and a distal end curving toward the second portion.

24. The system of claim 19 wherein each contact is mounted to a floor of the respective connector, the blade and the spring arm both extending longitudinally and generally perpendicularly with respect to the floor of the connector, the floor of the connector defining a well adjacent the blade arm, wherein when the contact is electrically coupled to a generally identical corresponding contact, the well accommodates the spring arm of the corresponding contact.

* * * * *